United States Patent [19]

Masumoto et al.

[11] 4,204,887

[45] May 27, 1980

[54] HIGH DAMPING CAPACITY ALLOY

[75] Inventors: Hakaru Masumoto; Showhachi Sawaya, both of Sendai, Japan

[73] Assignee: The Foundation: The Research Institute of Electric & Magnetic Alloys, Sendai, Japan

[21] Appl. No.: 881,847

[22] Filed: Feb. 27, 1978

Related U.S. Application Data

[63] Continuation of Ser. No. 672,313, Mar. 31, 1976, abandoned.

[30] Foreign Application Priority Data

Apr. 4, 1975 [JP] Japan ..... 50-41083

[51] Int. Cl.[2] ..... H01F 1/00

[52] U.S. Cl. ..... 148/31; 75/123 K; 75/126 B; 75/126 H; 148/134

[58] Field of Search ..... 75/123 K, 126 H, 128 B; 148/31, 12 R, 134

[56] References Cited

U.S. PATENT DOCUMENTS

| | | | |
|---|---|---|---|
| 3,331,715 | 7/1967 | Bulina | 148/142 |
| 3,661,658 | 5/1972 | Oda et al. | 75/128 B |
| 3,843,424 | 10/1974 | Thornburg et al. | 148/31.55 |
| 3,868,278 | 2/1975 | Foster et al. | 148/31.55 |
| 3,873,378 | 3/1975 | Webster | 148/37 |
| 3,892,604 | 7/1975 | Thornburg et al. | 75/123 K |
| 3,954,519 | 5/1976 | Inoue | 75/126 H |
| 3,977,919 | 8/1976 | Foster et al. | 148/31.55 |
| 4,059,462 | 11/1977 | Masumoto et al. | 75/123 J |

FOREIGN PATENT DOCUMENTS

| | | | |
|---|---|---|---|
| 4619780 | 12/1967 | Japan | 75/126 H |

OTHER PUBLICATIONS

Bozorth, "Ferromagnetism," 1951, pp. 100–209.

Cochardt, "High Damping Ferromagnetic Alloys," Journal of Metals, Trans. Aime, 10/1956, pp. 1295–1298.

Merriman, "A Dictionary of Metallurgy," 1958, p. 56.

*Primary Examiner*—L. Dewayne Rutledge
*Assistant Examiner*—Upendra Roy
*Attorney, Agent, or Firm*—Hill, Van Santen, Steadman, Chiara & Simpson

[57] ABSTRACT

A high damping capacity alloy comprising 1–45% by weight of Co and the remainder being Fe and, as the case may be, further comprising 0.01–30% in total, as an additional component, of at least one of Ni, Cr, Al, Cu, Mn, Sb, Nb, Mo, W, Ti, V, Ta, Si, Sn, Zn, Zr, C and Y, the alloy having high damping capacity more than $2\times10^{-3}$, high cold workability and high corrosion resistance over wide temperature range.

9 Claims, 2 Drawing Figures

HIGH DAMPING CAPACITY ALLOY

This is a continuation of application Ser. No. 672,313, filed Mar. 31, 1976 and now abandoned.

BACKGROUND OF THE INVENTION

1. Field of the Invention

The present invention relates to a high damping capacity alloy having high damping capacity more than $2\times10^{-3}$ over wide temperature range and more particularly to a high vibration damping capacity alloy having good cold workability and high corrosion resistance.

2. Description of the Prior Art

Recently, elements or members made of alloys having damping capacities have been widely used in precision instruments susceptible to vibrations, and machines such as aircraft, ships, vehicles and the like causing vibrations and noises for the purpose of mitigating the public nuisance resulting from the vibrations and noises.

In the prior art, alloys of Mn-Cu, Ni-Ti, Zn-Al, etc. having values of $Q^{-1}$ more than 0.005 have been commonly used. The value of $Q^{-1}$ indicates the inherent damping capacity of the alloy against vibration. When a body is vibrating in a damped oscillations, there is a following relation between first and n-th amplitudes $A_o$ and An of the vibration.

$$An=A_o \exp(n\delta),$$

where $\delta$ is logarithmic decrement and indicated as $\delta=\pi Q^{-1}$. On the other hand, if the vibrational energy E decreases by $\Delta E$ during one cycle, a relation between the amplitudes An−1 and An is expressed as $$\Delta E/E=\{(An-1)^2-An^2\}/An^2=2\pi Q^{-1}.$$

In other words, $Q^{-1}$ is a function of the energy decreased during one cycle. The larger value of $Q^{-1}$ decreases much more energy of the vibration so that the amplitude becomes smaller in a shorter period of time to exhibit a higher damping effect.

The alloys of Mn-Cu and Ni-Ti among the damping alloys of the prior art are superior in the damping capacity characteristics at room temperature to that of other alloy. However, as the temperature becomes higher, the damping capacity decreases rapidly and becomes substantially zero at the temperature near 100° C. such that the alloys cannot be distinguishable in damping capacity from normal metals at that temperature. Accordingly, such alloys do not exhibit any damping capacity at a temperature higher than 100° C. On the other hand, alloys of Zn-Al of the prior art have a high damping capacity at temperatures higher than 100° C. However, as the temperature becomes lower, it decreases rapidly and becomes a very small value at room temperature. These alloys of Mn-Cu, Ni-Ti and Zn-Al are poor in cold workability and corrosion resistance.

Accordingly, it has been expected to provide a damping alloy having a high damping capacity, high cold workability and high corrosion resistance over wide range of temperature.

SUMMARY OF THE INVENTION

A principal object of the invention is, therefore, to provide an improved high damping capacity alloy having a high damping capacity, high cold workability and high corrosion resistance over wide temperature range.

To accomplish the above object the alloy according to the invention comprising 1–45% by weight of cobalt and the remainder being iron and having a damping capacity more than $2\times10^{-3}$ against vibration.

In another aspect of the invention the alloy further comprises 0.01–30 weight % in total of additional component of at least one element selected from the group consisting of less than 30 weight % of nickel, less than 20 weight % of chrominum, aluminum and copper, less than 10 weight % of manganese, antimony, niobium, molybdenum, tungsten, titanium, vanadium and tantalum, less than 5 weight % of silicon, tin, zinc, zirconium, and less than 1 weight % of carbon and yttrium and having a damping capacity more than $2\times10^{-3}$ against vibration.

Another objects and advantages of the invention will become more apparent as the description proceeds, when considered with the example and accompanying drawings.

DESCRIPTION OF THE PREFERRED EMBODIMENTS

Figure 1:
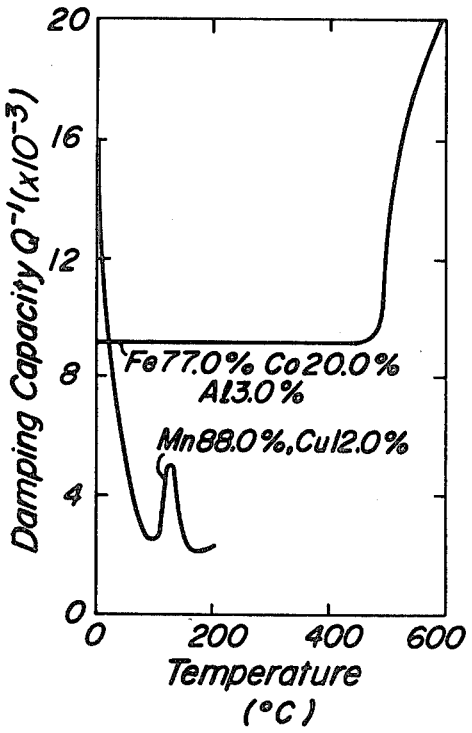
FIG. 1 is a graphical representation showing a difference between the damping capacity characteristics of the alloys of Fe-Co-Al according to the invention and Mn-Cu in the prior art.

According to the invention, a starting material consisting of 1–45% by weight of Co and the remainder of Fe is melted in air or inert gas or in vacuum in a conventional blast furnace. The starting material may have 0.01–30% of at least one additional component selected from the group consisting of less than 30% of Ni, less than 20% of Cr, Al, and/or Cu, less than 10% of Mn, Sb, Nb, Mo, W, Ti, V and/or Ta, less than 5% of Si, Sn, Zn and/or Zr, less than 1% of C and/or Y. Then the melt is added with a small amount (less than 1%) of manganese, silicon, titanium, aluminum, calcium and the like to remove undesirable impurities and thereafter sufficiently stirred to produce a melted alloy uniform in composition. Thus produced alloy is subjected to forging, rolling or swaging at room temperature or a temperature lower than 1,300° C. shape a blank material suitable for its application.

According to the invention the shaped article of the alloy is further subjected to the following treatments.

(A) After the article has been heated at a high temperature lower than its melting point for more than one minute and less than 100 hours, preferably 5 minutes to 50 hours, it is quenched by the cooling speed quicker than 1° C./sec (such as 1° C./sec–2,000° C./sec) or annealed by slow cooling at a rate of between 1° C. per second and 100° C./hour for the purpose of the homogenizing solution treatment.

(B) The formed article is cold worked after the above heat treatment of quenching or annealing.

(C) After the above heat treatment of quenching of the step (A) or cold working of the step (B), the formed article is heated at a temperature between 100° C. and lower than the temperature for the quenching (i.e. 800°–1,600° C.) for more than one minute to 100 hours, preferably 5 minutes to 50 hours and then cooled at a rate of slow cooling speed between 1° C. per second and 100° C./hour.

In the above solution treatment, the time of one minute to 100 hours for heating the blank depends upon the weight of the blank to be treated, the temperature at which it is heated and the composition thereof. In other words, a material having a high melting point such as 1,600° C. may be heated approximately at 1,600° C., so that the time for heating at the temperature may be short for example 1–5 minutes. On the other hand, when the heating is effected at a temperature near the lower limit 800° C., a long period of time such as 100 hours is necessary for the heating.

The heating time widely selected depending on the wide range of the material, weight or massiveness from 1 gram as in a laboratory scale to 1 ton as in a factory scale. In comparison at the same temperature, a small size of material only requires 1 minute to 5 hours for the solution treatment, while a large size of material requires 10–100 hours for the treatment.

If the heating for the solution treatment is satisfactorily effected, the cooling speed can be selected within a very wide range from the quick cooling quicker than 1° C./sec such as 1° C./sec to 1,000° C./sec to the slow cooling such as 1° C./sec–100° C./hr. Such an allowance of selection of the cooling speed depends upon whether the heating for the solution heat treatment is satisfactorily completed.

The present invention will be explained with reference to an example.

A mixture of total weight of about 500 grams having the composition of Fe and Co as shown in Table 1 was melted in an alumina crucible in a high-frequency induction furnace in an atmosphere of argon gas. After stirring the melt, it was poured into a mold to obtain an ingot having a square section of 35×35 mm. The ingot was then forged into a rod having a 10 mm diameter circular section. The rod was annealed at 1000° C. for one hour. Then the rod was drawn at room temperature to form a wire of 0.5 mm diameter which was then cut into a plurality of wires having suitable lengths. These wires was heated at 1,000° C. for one hour and cooled at a rate of 100° C. per hour to provide test pieces for measuring the damping capacity by the torsion pendulum method. Table 1 illustrates the results of the test. It is understood that the alloy according to the invention has a remarkably higher damping capacity (higher by the factor of several tens) than that $Q^{-1}=0.1(\times 10^{-3})$ of the steel of 0.1% carbon.

Table 1

| Composition | | Damping capacity $Q^{-1}(\times 10^{-3})$ | | | | | |
|---|---|---|---|---|---|---|---|
| | | 0 ° C. | 50 ° C. | 100 ° C. | 200 ° C. | 300 ° C. | 400 ° C. |
| Fe(%) | Co(%) | Annealed condition by cooling at a rate of 100 ° C./hr after heated at 1,000 ° C. for one hour | | | | | |
| 90.0 | 10.0 | 3.0 | 3.1 | 3.1 | 3.1 | 3.2 | 4.0 |
| 60.0 | 40.0 | 2.5 | 2.5 | 2.5 | 2.5 | 2.7 | 3.9 |
| | | 90% cold worked condition after annealed | | | | | |
| 90.0 | 10.0 | 2.8 | 2.8 | 2.8 | 2.8 | 3.0 | 3.9 |
| 60.0 | 40.0 | 2.4 | 2.4 | 2.4 | 2.6 | 2.7 | 3.7 |
| | | Water quenched condition after heated at 1,000 ° C. for one hour | | | | | |
| 90.0 | 10.0 | 2.3 | 2.3 | 2.3 | 2.4 | 3.0 | 3.8 |
| 60.0 | 40.0 | 2.4 | 2.4 | 2.4 | 2.5 | 2.6 | 3.6 |

Tables 2–4 show the damping capacities of the typical alloys according to the invention.

Table 2

| Composition | | | | Damping capacity $Q^{-1}(\times 10^{-3})$ | | | | | |
|---|---|---|---|---|---|---|---|---|---|
| | | | | 0° C. | 50° C. | 100° C. | 200° C. | 300° C. | 400° C. |
| Fe (%) | Co (%) | Added elements | (%) | Annealed condition by cooling at a rate of 100° C./hr after heated at 1,000° C. for one hour | | | | | |
| 79.8 | 20.0 | C | 0.2 | 4.0 | 4.0 | 4.1 | 4.2 | 4.2 | 4.7 |
| 79.4 | 20.0 | | 0.6 | 3.9 | 3.9 | 3.9 | 4.0 | 4.0 | 4.5 |
| 79.8 | 20.0 | Y | 0.2 | 4.5 | 4.5 | 4.5 | 4.5 | 4.6 | 5.0 |
| 79.4 | 20.0 | | 0.6 | 4.0 | 4.0 | 4.0 | 4.0 | 4.1 | 4.4 |
| 78.0 | 20.0 | Si | 2.0 | 3.5 | 3.5 | 3.5 | 3.5 | 4.0 | 6.0 |
| 76.0 | 20.0 | | 4.0 | 4.0 | 4.0 | 4.0 | 4.0 | 5.0 | 6.7 |
| 78.0 | 20.0 | Sn | 2.0 | 3.6 | 3.6 | 3.6 | 3.6 | 4.3 | 7.0 |
| 76.0 | 20.0 | | 4.0 | 4.1 | 4.1 | 4.1 | 4.1 | 5.2 | 7.3 |
| 78.0 | 20.0 | Zn | 2.0 | 3.4 | 3.4 | 3.4 | 3.4 | 4.4 | 6.1 |
| 76.0 | 20.0 | | 4.0 | 4.0 | 4.1 | 4.2 | 4.3 | 5.0 | 6.9 |
| 78.0 | 20.0 | Zr | 2.0 | 3.9 | 3.9 | 3.9 | 3.9 | 3.9 | 4.2 |
| 76.0 | 20.0 | | 4.0 | 3.5 | 3.5 | 3.5 | 3.5 | 3.5 | 3.7 |
| 77.0 | 20.0 | Mn | 3.0 | 5.5 | 5.5 | 5.5 | 5.6 | 5.6 | 6.0 |
| 72.0 | 20.0 | | 8.0 | 4.0 | 4.0 | 4.0 | 4.0 | 4.0 | 5.5 |
| 77.0 | 20.0 | Sb | 3.0 | 4.2 | 4.5 | 4.5 | 4.5 | 5.5 | 7.0 |
| 72.0 | 20.0 | | 8.0 | 4.3 | 4.3 | 4.3 | 4.3 | 5.0 | 6.6 |
| 77.0 | 20.0 | Nb | 3.0 | 4.2 | 4.2 | 4.3 | 4.3 | 4.6 | 4.9 |
| 72.0 | 20.0 | | 8.0 | 4.3 | 4.3 | 4.3 | 4.6 | 4.8 | 5.0 |
| 77.0 | 20.0 | Mo | 3.0 | 4.4 | 4.4 | 4.4 | 4.6 | 4.8 | 5.8 |
| 72.0 | 20.0 | | 8.0 | 5.0 | 5.0 | 5.0 | 5.0 | 5.7 | 6.1 |
| 77.0 | 20.0 | W | 3.0 | 4.2 | 4.2 | 4.2 | 4.3 | 4.6 | 4.9 |
| 72.0 | 20.0 | | 8.0 | 4.5 | 4.5 | 4.5 | 4.5 | 5.3 | 5.8 |
| 77.0 | 20.0 | Ti | 3.0 | 5.0 | 5.0 | 5.0 | 5.0 | 5.7 | 5.9 |
| 72.0 | 20.0 | | 8.0 | 4.1 | 4.2 | 4.2 | 4.3 | 4.4 | 5.7 |
| 77.0 | 20.0 | V | 3.0 | 5.3 | 5.3 | 5.3 | 5.4 | 5.6 | 5.8 |
| 72.0 | 20.0 | | 8.0 | 4.3 | 4.4 | 4.4 | 4.6 | 4.9 | 5.3 |
| 77.0 | 20.0 | Ta | 3.0 | 4.0 | 4.1 | 4.3 | 4.3 | 4.5 | 4.4 |
| 72.0 | 20.0 | | 8.0 | 4.2 | 4.3 | 4.5 | 4.6 | 4.7 | 4.8 |
| 75.0 | 20.0 | Cr | 5.0 | 6.4 | 6.4 | 6.4 | 6.4 | 6.8 | 7.8 |
| 65.0 | 20.0 | | 15.0 | 3.9 | 3.9 | 3.9 | 3.9 | 3.9 | 3.9 |
| 75.0 | 20.0 | Al | 5.0 | 8.8 | 8.8 | 8.8 | 8.8 | 9.0 | 10.5 |
| 65.0 | 20.0 | | 15.0 | 8.7 | 8.7 | 8.7 | 8.9 | 9.1 | 10.4 |
| 75.0 | 20.0 | Cu | 5.0 | 6.4 | 6.4 | 6.4 | 6.4 | 7.0 | 8.0 |
| 65.0 | 20.0 | | 15.0 | 5.9 | 5.9 | 5.9 | 5.9 | 6.0 | 7.8 |
| 70.0 | 20.0 | Ni | 10.0 | 6.5 | 6.5 | 6.5 | 6.5 | 6.5 | 7.0 |
| 55.0 | 20.0 | | 25.0 | 4.4 | 4.4 | 4.4 | 4.4 | 4.4 | 5.0 |

Table 3

| Composition | | | | Damping capacity $Q^{-1}(\times 10^{-3})$ | | | | | |
|---|---|---|---|---|---|---|---|---|---|
| | | | | 0° C. | 50° C. | 100 °C. | 200 °C. | 300 °C. | 400 °C. |
| Fe (%) | Co (%) | Added elements | (%) | 96% cold worked condition after annealed | | | | | |
| 79.8 | 20.0 | C | 0.2 | 3.5 | 3.5 | 3.5 | 3.6 | 3.6 | 4.0 |
| 79.4 | 20.0 | | 0.6 | 3.8 | 3.8 | 3.8 | 3.8 | 3.8 | 3.9 |
| 79.8 | 20.0 | Y | 0.2 | 4.2 | 4.2 | 4.2 | 4.2 | 4.2 | 4.4 |
| 79.4 | 20.0 | | 0.6 | 3.8 | 3.9 | 3.9 | 3.9 | 4.0 | 4.3 |
| 78.0 | 20.0 | Si | 2.0 | 3.3 | 3.3 | 3.3 | 3.3 | 3.4 | 4.0 |
| 76.0 | 20.0 | | 4.0 | 3.5 | 3.5 | 3.5 | 3.5 | 3.6 | 4.3 |
| 78.0 | 20.0 | Sn | 2.0 | 3.2 | 3.2 | 3.2 | 3.4 | 3.5 | 3.7 |
| 76.0 | 20.0 | | 4.0 | 3.5 | 3.5 | 3.5 | 3.5 | 3.6 | 3.8 |
| 78.0 | 20.0 | Zn | 2.0 | 3.1 | 3.2 | 3.2 | 3.2 | 3.2 | 3.6 |
| 76.0 | 20.0 | | 4.0 | 3.4 | 3.4 | 3.4 | 3.4 | 3.4 | 3.8 |
| 78.0 | 20.0 | Zr | 2.0 | 3.5 | 3.5 | 3.5 | 3.5 | 3.5 | 3.7 |
| 76.0 | 20.0 | | 4.0 | 3.2 | 3.2 | 3.2 | 3.2 | 3.4 | 3.5 |
| 77.0 | 22.0 | Mn | 3.0 | 5.4 | 5.4 | 5.5 | 5.6 | 5.6 | 5.7 |
| 72.0 | 20.0 | | 8.0 | 5.0 | 5.0 | 5.0 | 5.0 | 5.2 | 5.6 |
| 77.0 | 20.0 | Sn | 3.0 | 4.0 | 4.0 | 4.0 | 4.0 | 4.2 | 4.5 |
| 72.0 | 20.0 | | 8.0 | 3.9 | 3.9 | 3.9 | 3.9 | 3.9 | 4.0 |
| 77.0 | 20.0 | Nb | 3.0 | 3.6 | 3.6 | 3.6 | 3.6 | 3.7 | 3.9 |
| 72.0 | 20.0 | | 8.0 | 3.5 | 3.5 | 3.5 | 3.5 | 3.6 | 3.8 |
| 77.0 | 20.0 | Mo | 3.0 | 4.0 | 4.0 | 4.0 | 4.0 | 4.0 | 4.4 |
| 72.0 | 20.0 | | 8.0 | 4.1 | 4.1 | 4.1 | 4.1 | 4.1 | 4.5 |
| 77.0 | 20.0 | W | 3.0 | 3.8 | 3.8 | 3.8 | 3.8 | 3.8 | 4.0 |
| 72.0 | 20.0 | | 8.0 | 4.0 | 4.0 | 4.0 | 4.0 | 4.2 | 4.5 |
| 77.0 | 20.0 | Ti | 3.0 | 4.3 | 4.3 | 4.3 | 4.3 | 4.3 | 4.5 |
| 72.0 | 20.0 | | 8.0 | 4.0 | 4.0 | 4.0 | 4.0 | 4.0 | 4.3 |
| 77.0 | 20.0 | V | 3.0 | 5.0 | 5.0 | 5.0 | 5.0 | 5.0 | 5.1 |
| 72.0 | 20.0 | | 8.0 | 4.1 | 4.1 | 4.2 | 4.3 | 4.3 | 4.5 |
| 77.0 | 20.0 | Ta | 3.0 | 3.8 | 3.8 | 3.8 | 3.8 | 3.8 | 3.9 |
| 72.0 | 20.0 | | 8.0 | 3.7 | 3.7 | 3.7 | 3.7 | 3.8 | 3.9 |

Table 3-continued

| Composition | | | | Damping capacity $Q^{-1}$ ($\times 10^{-3}$) 0° C. | 50° C. | 100 °C. | 200 °C. | 300 °C. | 400 °C. |
|---|---|---|---|---|---|---|---|---|---|
| 75.0 | 20.0 | Cr | 5.0 | 5.5 | 5.5 | 5.5 | 5.5 | 5.6 | 5.7 |
| 65.0 | 20.0 | | 15.0 | 3.7 | 3.7 | 3.7 | 3.7 | 3.7 | 3.8 |
| 75.0 | 20.0 | Al | 5.0 | 7.0 | 7.0 | 7.0 | 7.0 | 7.0 | 7.4 |
| 65.0 | 20.0 | | 15.0 | 6.8 | 6.8 | 6.8 | 6.8 | 6.8 | 6.9 |
| 75.0 | 20.0 | Cu | 5.0 | 5.5 | 5.5 | 5.5 | 5.6 | 5.7 | 6.0 |
| 65.0 | 20.0 | | 15.0 | 4.5 | 4.5 | 4.5 | 4.5 | 4.6 | 4.8 |
| 70.0 | 20.0 | Ni | 10.0 | 5.1 | 5.2 | 5.2 | 5.2 | 5.2 | 5.3 |
| 55.0 | 20.0 | | 25.0 | 4.0 | 4.0 | 4.0 | 4.0 | 4.0 | 4.3 |

Table 4

| Composition | | | | Damping capacity $Q^{-1}$ ($\times 10^{-3}$) 0° C. | 50° C. | 100 °C. | 200 °C. | 300 °C. | 400 °C. |
|---|---|---|---|---|---|---|---|---|---|
| Fe (%) | Co (%) | Added elements | (%) | Water quenched condition after heated at 1,000° C. for one hour | | | | | |
| 79.8 | 20.0 | C | 0.2 | 3.4 | 3.4 | 3.4 | 3.5 | 3.5 | 3.8 |
| 79.4 | 20.0 | | 0.6 | 3.2 | 3.2 | 3.2 | 3.2 | 3.3 | 3.5 |
| 79.8 | 20.0 | Y | 0.2 | 4.0 | 4.0 | 4.0 | 4.0 | 4.0 | 4.2 |
| 79.4 | 20.0 | | 0.6 | 3.7 | 3.7 | 3.7 | 3.8 | 3.8 | 3.9 |
| 78.0 | 20.0 | Si | 2.0 | 3.1 | 3.2 | 3.2 | 3.2 | 3.3 | 3.4 |
| 76.0 | 20.0 | | 4.0 | 3.4 | 3.4 | 3.4 | 3.4 | 3.4 | 3.5 |
| 78.0 | 20.0 | Sn | 2.0 | 3.0 | 3.0 | 3.0 | 3.0 | 3.0 | 3.0 |
| 76.0 | 20.0 | | 4.0 | 3.3 | 3.3 | 3.3 | 3.1 | 3.2 | 3.3 |
| 78.0 | 20.0 | Zn | 2.0 | 3.0 | 3.0 | 3.0 | 3.0 | 3.0 | 3.0 |
| 76.0 | 20.0 | | 4.0 | 3.2 | 3.2 | 3.2 | 3.2 | 3.2 | 3.3 |
| 78.0 | 20.0 | Zr | 2.0 | 3.4 | 3.4 | 3.4 | 3.4 | 3.5 | 3.7 |
| 76.0 | 20.0 | | 4.0 | 3.3 | 3.3 | 3.3 | 3.4 | 3.4 | 3.6 |
| 77.0 | 20.0 | Mn | 3.0 | 5.3 | 5.3 | 5.4 | 5.5 | 5.5 | 5.7 |
| 72.0 | 20.0 | | 8.0 | 4.9 | 4.9 | 4.9 | 4.9 | 4.9 | 5.0 |
| 77.0 | 20.0 | Sb | 3.0 | 3.7 | 3.7 | 3.7 | 3.7 | 3.8 | 3.8 |
| 72.0 | 20.0 | | 8.0 | 3.5 | 3.5 | 3.5 | 3.5 | 3.7 | 3.7 |
| 77.0 | 20.0 | Nb | 3.0 | 3.4 | 3.4 | 3.4 | 3.4 | 3.4 | 3.5 |
| 72.0 | 20.0 | | 8.0 | 3.3 | 3.3 | 3.3 | 3.3 | 3.3 | 3.4 |
| 77.0 | 20.0 | Mo | 3.0 | 3.8 | 3.8 | 3.8 | 3.8 | 3.8 | 3.8 |
| 72.0 | 20.0 | | 8.0 | 4.0 | 4.0 | 4.0 | 4.0 | 4.0 | 4.0 |
| 77.0 | 20.0 | W | 3.0 | 3.8 | 3.8 | 3.8 | 3.8 | 3.8 | 3.9 |
| 72.0 | 20.0 | | 8.0 | 3.7 | 3.7 | 3.7 | 3.7 | 3.7 | 3.8 |
| 77.0 | 20.0 | Ti | 3.0 | 4.2 | 4.2 | 4.2 | 4.2 | 4.2 | 4.3 |
| 72.0 | 20.0 | | 8.0 | 3.9 | 3.9 | 3.9 | 3.9 | 3.9 | 4.0 |
| 77.0 | 20.0 | V | 3.0 | 3.9 | 3.9 | 3.9 | 3.9 | 3.9 | 4.0 |
| 72.0 | 20.0 | | 8.0 | 3.8 | 3.8 | 3.8 | 3.8 | 3.8 | 3.9 |
| 77.0 | 20.0 | Ta | 3.0 | 3.9 | 3.9 | 4.0 | 4.0 | 4.0 | 4.0 |
| 72.0 | 20.0 | | 8.0 | 3.6 | 3.6 | 3.6 | 3.6 | 3.6 | 3.6 |
| 75.0 | 20.0 | Cr | 5.0 | 5.4 | 5.4 | 5.4 | 5.4 | 5.4 | 5.5 |
| 65.0 | 20.0 | | 15.0 | 3.6 | 3.6 | 3.7 | 3.7 | 3.8 | 3.9 |
| 75.0 | 20.0 | Al | 5.0 | 5.5 | 5.5 | 5.5 | 5.5 | 5.6 | 5.8 |
| 65.0 | 20.0 | | 15.0 | 4.5 | 4.5 | 4.5 | 4.5 | 4.5 | 4.6 |
| 75.0 | 20.0 | Cu | 5.0 | 4.2 | 4.2 | 4.2 | 4.2 | 4.3 | 4.4 |
| 65.0 | 20.0 | | 15.0 | 4.0 | 4.0 | 4.0 | 4.0 | 4.0 | 4.2 |
| 70.0 | 20.0 | Ni | 10.0 | 4.0 | 4.1 | 4.1 | 4.1 | 4.1 | 4.3 |
| 55.0 | 20.0 | | 25.0 | 3.9 | 3.9 | 3.9 | 4.0 | 4.0 | 4.0 |

As can be seen from Tables 1–4, the damping capacity of the alloy according to the invention is very high irrespective of binary or ternary alloy and the treatments. The damping capacity of the alloys is highest under the annealed condition, and decreases in the order of the cold worked and water quenched conditions. The values of the damping capacity are much higher by the factor of several tens than those of the normal metals.

FIG. 1 illustrates the relationship between the heating temperature and the damping capacity of the alloys of Fe 77.0%, Co 20.0% and Al 3.0% and Mn 88.0% and Cu 12.0% under annealed condition. It should be understood from the graph of FIG. 1 that the damping capacity of the alloy according to the invention is very high at room and high temperatures in comparison with the Mn-Cu alloy. There is a tendency of the alloy according to the invention to increase the modulus of elasticity and hardness with the increase of the amount of the additional components.

Figure 2:
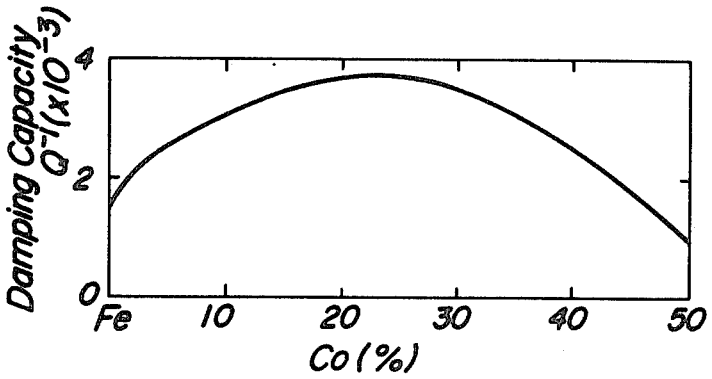
FIG. 2 is a graphical representation of a relationship between the composition and damping capacity of the alloy of Fe-Co according to the invention.

FIG. 2 shows the relationship between the damping capacity and the amount of cobalt of the Fe-Co alloy according to the invention.

As can be seen from the above description that the alloy according to the invention can be very effectively used as damping alloy elements for the precision instruments susceptible to vibrations and the machines such as aircraft, ships, vehicles, and the like causing vibrations and noises.

The reason for the limitation of composition of the alloy according to the invention is as follows.

The cobalt is limited to 1–45% and iron to the remainder of the binary alloy because the damping capacity higher than $2\times10^{-3}$ aimed in the invention could not be obtained by alloys deviated from the limitation of the cobalt and iron.

The high damping capacity aimed in the present invention can be accomplished by replacing a part of cobalt and iron of the binary alloy within 0.01–30% with any one or more of Ni, Cr, Al, Cu, Mn, Sb, Nb, Mo, W, Ti, V, Ta, Si, Sn, Zn, Zr, C and Y.

In the ternary alloys of Fe-Co-C, Fe-Co-Y, Fe-Co-Zr, Fe-Co-Mn, Fe-Co-Sb, Fe-Co-Nb, Fe-Co-Al, and Fe-Co-Cu according to the invention, C or Y is limited to less than 1%, Zn to less than 5%, Mn, Sb or Nb to less than 10%, and Al or Cu to less than 20% because alloys deviated from the above limitation could not accomplish the damping capacity higher than $2\times10^{-3}$ aimed in the invention and did not exhibit the desired corrosion resistance.

Moreover, in the ternary alloys of Fe-Co-Si, Fe-Co-Sm, Fe-Co-Zn, Fe-Co-Mo, Fe-Co-W, Fe-Co-Ti, Fe-Co-V, Fe-Co-Ta, and Fe-Co-Cr according to the invention, Si, Sn or Zn is limited to less than 5%, Mo, W, Ti, V or Ta to less than 10%, and Cu to less than 20%, because alloys deviated from the limitation did not exhibit the damping capacity higher than $2\times10^{-3}$ and good cold workability aimed in the present invention.

In the ternary alloy of Fe-Co-Ni, Ni is limited to less than 30%, because an alloy having Ni more than 30% could not accomplish the damping capacity higher than $2\times10^{-3}$ aimed in the present invention.

While several examples have been herein disclosed, it is obvious that various changes can be made without departing from the spirit and scope of the invention as set forth in the appended claims.

What is claimed is:

1. A process for producing a high damping capacity alloy comprising the steps of melting a starting material consisting of 1–45% by weight of Co and the remainder being Fe in a furnace, adding to the melt a small amount less than 1% of an element selected from a group consisting of manganese, silicon, titanium, aluminum and calcium so as to remove undesirable impurities, shaping the product into a desired form, heating the thus formed article at a high temperature between its melting point and above 800° C. for more than one minute to 100 hours, preferably 5 minutes to 50 hours, and cooling the article at a suitable cooling rate to room temperature.

2. A process for producing a high damping capacity alloy comprising the steps of melting a starting material consisting essentially of 1–20 weight % of cobalt and remainder iron as a main component and further including a 0.01–30 weight % in total of an additional subcomponent consisting of at least one element selected from the group consisting of less than 20 weight % of chromium, aluminum and copper, less than 10 weight % of manganese, antimony, niobium, molybdenum, tungsten, titanium, vanadium and tantalum, less than 5 weight % of silicon, tin, zinc, zirconium, and less than 1 weight % of yttrium in a furnace, adding to the melt a small amount less than 1% of an element selected from a group consisting of manganese, silicon, titanium, aluminum and calcium so as to remove undesirable impurities, shaping the product into a desired form, heating the thus formed article at a high temperature between its melting point and above 800° C. for more than one minute to 100 hours, and cooling the article at a suitable cooling rate to room temperature to produce an alloy having a damping capacity more than $2\times10^{-3}$ against vibration.

3. A process as defined in claim 2, wherein said shaping step is effected at a temperature between 1,300° C. and room temperature by any one of casting, forging, rolling and swaging.

4. A process according to claim 2, wherein the step of heating the article heats the article for a period of 5 minutes to 50 hours.

5. A process in accordance with claim 2, which includes after the step of cooling, reheating the article at a temperature between 100° C. and 1600° C. for more than one minute and up to 100 hours, and then annealing the article at a slow cooling speed in a range of 1° C. per second to 100° C. per hour.

6. A heat treated alloy consisting essentially of up to 20% by weight cobalt and the remainder being iron as a main component, and including 0.01–30 weight % in total of an additional component of at least one element selected from a group consisting of less than 20 weight % of chromium, aluminum and copper, less than 10 weight % of manganese, antimony, niobium, molybdenum, tungsten, titanium, vanadium and tantalum, less than 5 weight % of silicon, tin, zinc, zirconium and less than 1 weight % of carbon and yttrium, said alloy being subjected to a heat treatment which comprises melting the alloy, casting the molten alloy, shaping the casting into a desired form for an article, heating the formed article to a high temperature between its melting point and above 800° C. for more than one minute and up to 100 hours, and then cooling the article at a suitable cooling rate to room temperature so that the alloy of the article has a damping capacity of more than $2\times10^{-3}$ against vibration.

7. A heat treated alloy according to claim 6, wherein the heat treatment includes after the step of cooling, reheating the article to a temperature between 100° C. and 1600° C. for more than one minute and up to 100 hours, and then annealing the article at a slow cooling speed in the range of 1° C. per second to 100° C. per hour.

8. A process for producing a high damping capacity alloy comprising the steps of melting a starting material consisting essentially of 1–20 weight % of cobalt, 0.01–20 weight % of chromium and remainder iron as a main component and further including 0.01–30 weight % in total of an additional subcomponent consisting of at least one element selected from the group consisting of less than 20 weight % of aluminum and copper, less than 10 weight % of manganese, antimony, niobium, molybdenum, tungsten, titanium, vanadium and tantalum, less than 5 weight % of silicon, tin, zinc, zirconium, and less than 1 weight % of yttrium in a furnace, shaping the product into a desired form, heating and thus formed article at high temperature between its melting point and above 800° C. for more than one minute to 100 hours, and cooling the article at a suitable cooling rate to room temperature to produce an alloy having a damping capacity more than $2\times10^{-3}$ against vibration.

9. A heat treated, high damping capacity alloy consisting essentially of up to 20% by weight of cobalt, and the remainder being iron as a main component, and further including 0.01–30 weight % in total of additional component of at least one element selected from the group consisting of less than 20 weight % of chromium, aluminum and copper, less than 10 weight % of manganese, antimony, niobium, molybdenum, tungsten, titanium, vanadium and tantalum, less than 5 weight % of silicon, tin, zinc, zirconium, and less than 1 weight % of carbon and yttrium and having a damping capacity of more than $2\times10^{-3}$ against vibration.

* * * * *